US007163334B2

(12) United States Patent
Chase et al.

(10) Patent No.: US 7,163,334 B2
(45) Date of Patent: Jan. 16, 2007

(54) METHOD AND APPARATUS FOR MIXING FIBERS

(75) Inventors: George Chase, Wadsworth, OH (US); Darrell Reneker, Akron, OH (US); Srihari Rangarajan, Glendale Heights, IL (US); Ketan Mehta, Burnsville, MN (US)

(73) Assignee: The University of Akron, Akron, OH (US)

( * ) Notice: Subject to any disclaimer, the term of this patent is extended or adjusted under 35 U.S.C. 154(b) by 255 days.

(21) Appl. No.: 10/220,991

(22) PCT Filed: Mar. 9, 2001

(86) PCT No.: PCT/US01/07594

§ 371 (c)(1),
(2), (4) Date: Nov. 18, 2002

(87) PCT Pub. No.: WO01/68228

PCT Pub. Date: Sep. 20, 2001

(65) Prior Publication Data

US 2003/0210606 A1 Nov. 13, 2003

(51) Int. Cl.
*B01F 5/04* (2006.01)

(52) U.S. Cl. ..... 366/101; 366/107; 366/173.1

(58) Field of Classification Search ..... 366/101, 366/107, 173.1; 162/149
See application file for complete search history.

(56) References Cited

U.S. PATENT DOCUMENTS 1,872,548 A * 8/1932 Lowen ..... 366/101
2,605,084 A * 7/1952 Reents et al. ..... 366/348
3,039,914 A * 6/1962 Reiman ..... 162/145
3,081,239 A * 3/1963 Clauss et al. ..... 366/107
3,175,807 A * 3/1965 Gouveia ..... 366/103
3,577,312 A * 5/1971 Videen et al. ..... 162/148
3,754,417 A * 8/1973 Jamieson ..... 366/107
3,773,301 A * 11/1973 Bergeron ..... 366/101
3,998,690 A 12/1976 Lyness et al. ..... 162/141
4,112,174 A 9/1978 Hannes et al. ..... 428/220
4,196,027 A 4/1980 Walker et al. ..... 156/62.2
4,215,682 A 8/1980 Kubik et al. ..... 128/205.29
4,260,265 A * 4/1981 Faverty et al. ..... 366/101
4,293,378 A 10/1981 Klein ..... 162/145
4,303,472 A 12/1981 Walker et al. ..... 162/221
4,335,965 A * 6/1982 Faverty et al. ..... 366/101
4,523,995 A 6/1985 Pall et al. ..... 210/504
4,944,598 A * 7/1990 Steele ..... 366/106
5,118,942 A 6/1992 Hamade ..... 250/324
5,607,491 A 3/1997 Jackson et al. ..... 55/528
5,728,298 A 3/1998 Hamlin ..... 210/491
5,871,845 A 2/1999 Dahringer et al. ..... 428/378
5,876,537 A 3/1999 Hill et al. ..... 156/89.11
5,877,099 A 3/1999 Cohen ..... 442/405
5,906,743 A 5/1999 Cohen et al. ..... 210/502.1
5,985,112 A 11/1999 Fischer ..... 204/283

* cited by examiner

*Primary Examiner*—Tony G. Soohoo
(74) *Attorney, Agent, or Firm*—Roetzel & Andress; George W. Moxon, II

(57) ABSTRACT

A method of mixing including providing a slurry (26, 126) having a first fiber (14, 114) into a container (20, 120), introducing an agitation fluid (31, 138) into the slurry to cause a mixing motion (38, 138) within the slurry, and delivering a second fiber (16, 116) into the slurry, whereby the mixing motion mixes the first and second fibers to create a fiber mixture.

13 Claims, 9 Drawing Sheets

METHOD AND APPARATUS FOR MIXING FIBERS

TECHNICAL FIELD

The present invention generally relates to non-woven media and methods of producing the same. More particularly, the invention relates to an apparatus and method for mixing fibers. Specifically, the present invention relates to delivering first and second fibers into a fluid medium to form a slurry, and introducing an agitating fluid into the slurry to mix the fibers.

BACKGROUND OF THE INVENTION

Fiber mixtures are often used to form filter media and other non-woven media. In the formation of these media, fibers are mixed in a variety of ways. The fibers may be dry mixed in air, or other gas, or wet mixed in water, or other liquid. One common difficulty with dry mixing is the build up of a static charge that prevents the fibers from mingling. While the build up of static charge is less problematic in wet mixing this type of mixing has its own hurdles. In wet mixing, the fibers may gather at the surface forming a membrane that floats on the surface with out mixing at depth with fibers contained in the liquid below. The use of electrospun or other fibers that are quenched upon contact with the liquid exacerbates this problem because, as the fibers are quenched at the surface, they form a single tangled membrane. This membrane does not separate to mix with the other fibers.

To force mixing, attempts have been made to agitate the fiber containing slurry with mechanical elements such as an impeller. While this technique provides some relief by drawing the fibers downward within the slurry, the fibers unfortunately wrap themselves around the impeller and its shaft. With the fibers ensorceling the impeller, these fibers are not free to intermingle with the fibers in the surrounding liquid. Similar to the use of an impeller, introducing elements through the surface of the slurry is known to cause the fibers to wrap themselves around these elements. The central problem in each situation is the agglomeration of fibers preventing the mixing of two types of fibers to any depth. In other words, the short fibers are found at the surface of the resultant long fiber membrane without penetration into the matrix of long fibers.

SUMMARY OF THE INVENTION

It is thus an object of the present invention to provide an improved method of mixing fibers.

It is another object of the present invention to provide a method of mixing long and short fibers that improves penetration of short fibers within a long fiber matrix.

Generally, the present invention provides a method of mixing and its resultant article, where the method includes providing a slurry having a first fiber into a container, introducing an agitation fluid into the slurry to cause a mixing motion within the slurry; and delivering a second fiber into the slurry, whereby the mixing motion mixes the first and second fibers to create a fiber mixture.

The present invention provides a fiber-mixing apparatus including a container receiving a slurry having short fibers therein, a fluid delivery assembly in fluid communication with the container and a fluid supply, whereby said fluid delivery assembly delivers an agitation fluid into the slurry, and delivery assembly delivering long fibers into the slurry, whereby delivery of said agitation fluid causes mixing of the long fibers and short fibers.

The present invention still further provides a multi-fiber structure including a mixture of first fibers and second fibers forming a fiber matrix, where at least a portion of the first fibers penetrate the matrix.

At least one or more of the foregoing objects of the present invention, as well as the advantages thereof over existing prior art forms, which will become apparent from the description to follow, are accomplished by the improvements hereinafter described and claimed.

BEST MODE FOR CARRYING OUT THE INVENTION

Figure 1:
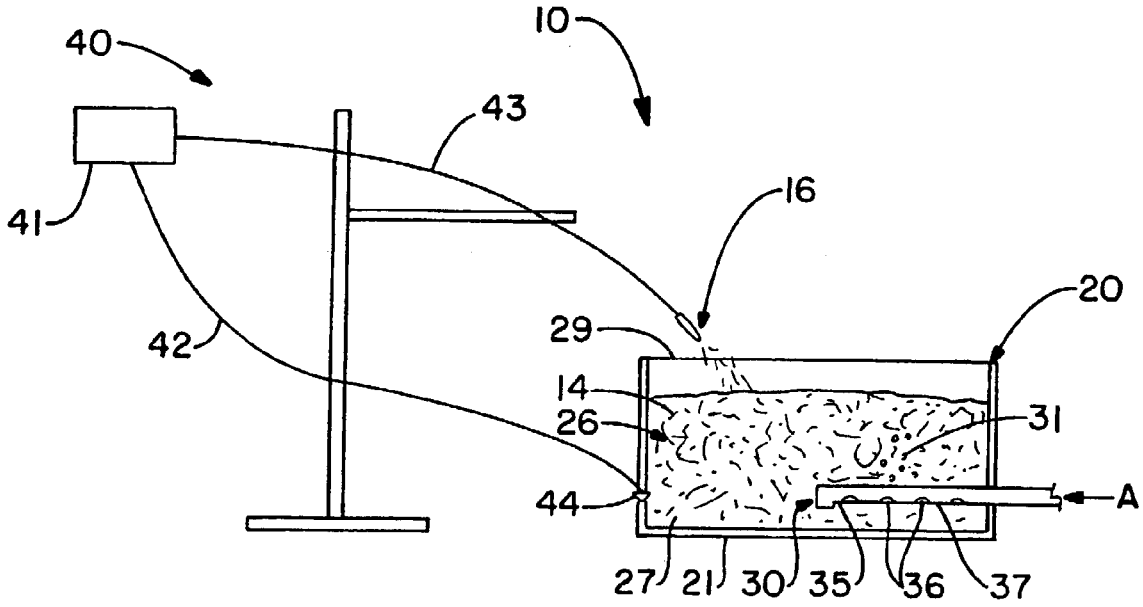
FIG. 1 is a schematic side view of a fiber-mixing apparatus according to the present invention showing a long fiber delivery assembly, a container housing a slurry of short fibers and a current generating assembly.

In a fiber-mixing process, according to the present invention, a first fiber is provided in a fluid to form a slurry, which is provided in a suitable container. A mixing motion is imparted to the slurry by a current generation assembly. Second fibers are provided into the slurry and the rolling motion of the slurry mixes the first and second fibers together. The resulting mixture has first fibers penetrating the matrix of second fibers or otherwise being dispersed within and throughout the resulting mixed fiber media. Since it is believed that the method and apparatus described herein could be used with fibers of any size, type, or relative length, the fibers will be referred to generally as fibers or, when referring to differing fibers, a first fiber and a second fiber. It will be understood that more than two fibers may be mixed and reference to first and second fibers does not limit the invention to a maximum of two fibers. It is believed that the invention may be used to mix any number of fibers.

When using two of more fibers of different relative lengths, the shorter fiber may have a length limited only by its ability to disperse within the slurry fluid. For example, fibers of about one millimeter or less may be used. Other suitable short fibers could fall within the range of about one micron to about ten microns in length. A long fiber, in such a case, would be longer in length than the short fibers. A fiber may be considered a long fiber when it is greater than one millimeter in length. The length of a long fiber could be, in the case of polymeric nanofibers, on the order of kilometers. It is believed that fibers having varying lengths may be used in the slurry and blends of long and short fibers may be used as long as they are able to disperse. This may largely depend on the volume of liquid in the slurry. As will be appreciated, the size of the container and other related apparatus components may be modified to accommodate virtually any fiber.

The above description of fibers is generally provided for background purposes. The apparatus described below is believed to be capable of mixing virtually any long and short fiber combinations. Further, the below described apparatus is capable of receiving manufactured, synthetic, and natural fibers. It will be understood that to accommodate different fibers, it may be necessary to vary the operating conditions of the apparatus. For example, the density, PH, temperature, pressure or other operating conditions of the process may be altered, as necessary. If desirable, the fibers may be treated by mechanical, electrical, or chemical means prior to mixing.

To perform mixing, the present invention includes a mixing apparatus referred to generally by the numeral 10 in the Figures. In general, the fiber-mixing apparatus 10 includes a container 20, a current generating assembly generally referred to by the numeral 30: and a fiber delivery assembly 40.

Figure 3:
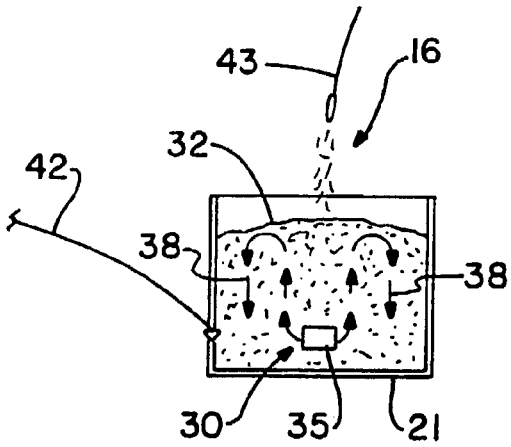
FIG. 3 is a front schematic view thereof depicting mixing of the fibers with the current generated by the current generating assembly represented by arrows.
Figure 4:
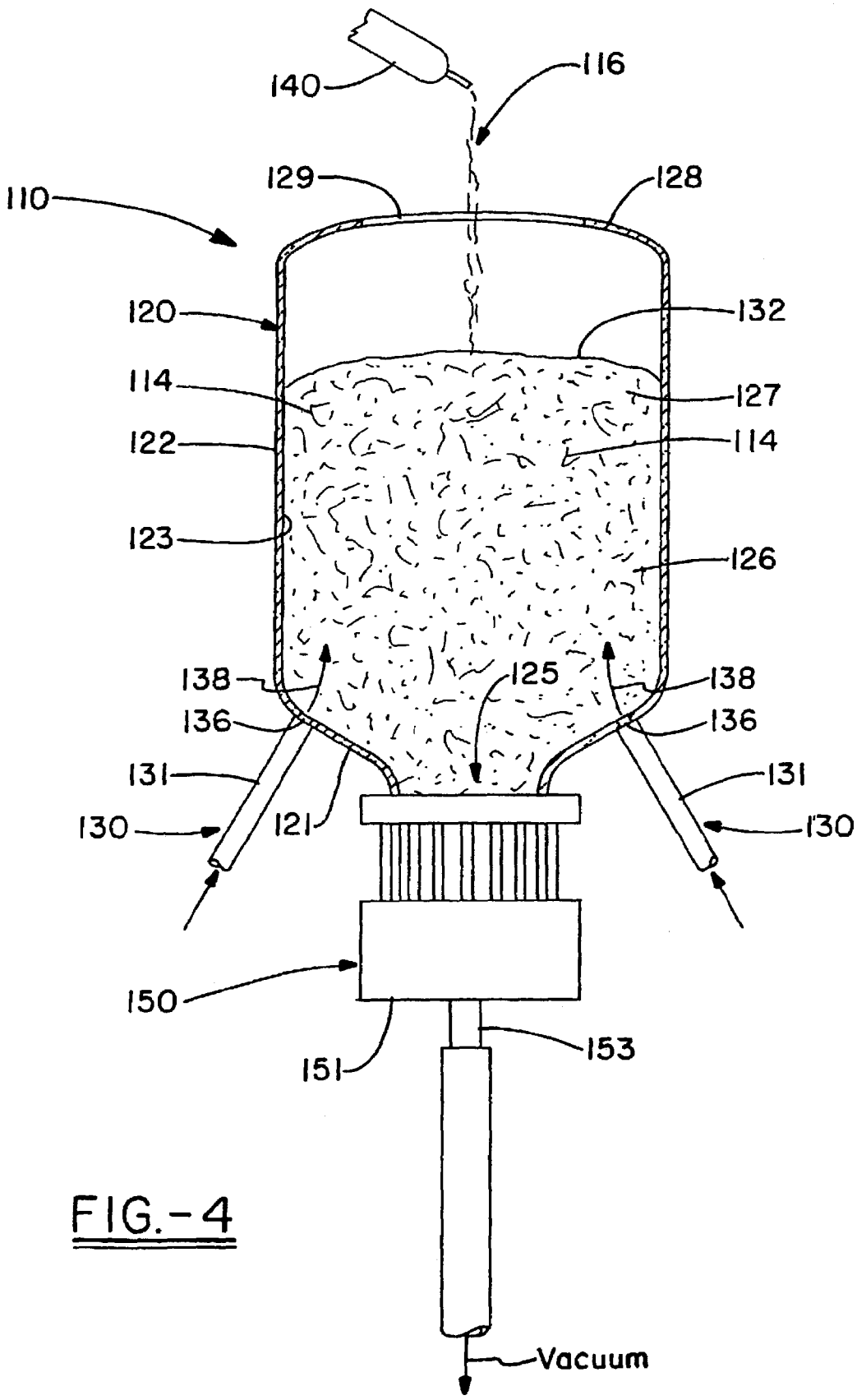
FIG. 4 is a schematic side view of an alternative fiber mixing apparatus according to the present invention.

Container 20 may be of any shape, size, or configuration, and, thus, will be described in general terms. Container 20 has a floor 21 and at least one side wall 22 extending upwardly from floor 21 to define a cavity 23, in which a fluid 27 may be received. As best shown in FIG. 3, the side wall 22 defines a perimeter 24, which in the case of a cylindrical side wall would generally be its circumference. As necessary container 20 may be provided with a lid or shield to keep fluids with the container. Container 20 is provided with at least one opening 25 to receive fibers, as described more completely below. As shown in FIG. 4, opening 25 may simply be the open end of container 20. As the method of fiber of delivery requires, openings may be provided in the floor 21, side wall 22, or lid to receive the fibers within the container 20.

For the mixing process, a slurry 26 including a fluid 27 and a plurality of fibers 14 is received in container 20. As previously described, the particular fluid 27 may depend on the fibers being used in the mixture. As will be understood from the term fluid, fluid 27 may be liquid or gas with attention being paid to the ability of the particular fluid to disperse the fibers. In one representative embodiment, fluid 27 was water and glass fibers 14 were used.

The current generating assembly 30 is used to create a mixing motion within the container 20. As best shown in FIG. 3, the current generating assembly 30 provides an agitation fluid, represented by arrows 31, into the slurry 26 to set up the mixing motion. The agitation fluid may be gaseous or liquid and is provided to the container 20 from a suitable source. A fluid having a density other than that of the slurry 22 may be used such that the agitation fluid 31 separates from the slurry 26. The agitation fluid 31 may have a density less than the fluid medium 27 of slurry 26 such that, during operation of the apparatus 10, the agitation fluid 31 would rise toward the surface 32 of the slurry 26. Further, due to the differences in density, the agititation fluid 31 eventually escapes the surface 32 of slurry 26. In one representative embodiment, the fluid medium 27 of the slurry 26 is water, and the agitation fluid 31 being delivered into the slurry is air A. In this embodiment the air A would bubble upward through the water as it is delivered. As will be readily understood, in delivering the agitation fluid 31 to the container 20, the agitation fluid 31 may be pumped or delivered from a pressurized source. A variety of fluid delivery means may be used to accomplish the generation of currents within the slurry 26 as will be described below.

Figure 2:
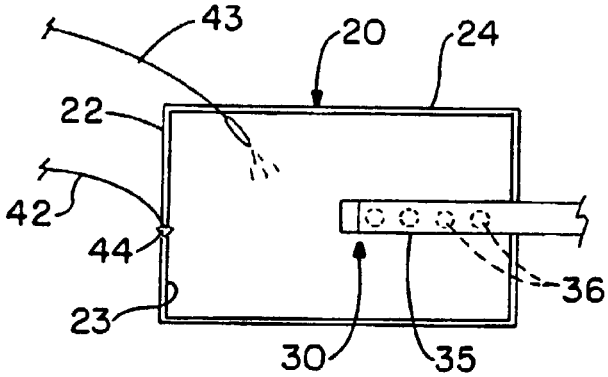
FIG. 2 is a top view thereof.

In one representative current generating assembly, depicted in FIGS. 1–3, one current generating assembly 30, includes a wand 35 that enters the container 20 below the surface 32 of slurry 26. Wand 35 contains at least one opening 36 and for delivering agitation fluid 31 into the slurry 26. In the embodiment shown, the opening 36 is formed on the lower surface 37 of wand 35. So situated, the incoming air bubbles out of the bottom of wand 35 and flows upwardly on either side of wand 35, setting up a substantially U-shaped flow or current, represented by arrows 38, on either side of wand 35, as depicted in FIG. 3. As shown in FIGS. 1 and 2, the wand 35 may be placed generally centrally within container 20, allowing the current 38 to fully develop on either side of wand 35. These currents 38 draw the second fibers 16 downward into the first fiber containing slurry 26 to effect mixing of the first and second fibers 14, 16.

It will be readily appreciated that other or additional current generating assemblies 30 may be used to generate a mixing motion within container 20. In its most basic form, the current generating assembly 30 is an opening through which the agitation fluid 31 enters the slurry 26. The current generating assembly may incorporate multiple openings randomly scattered or arranged in patterns along the inside surface of the container 20. To achieve different flow characteristics for the agitation fluid 31, the current generating assembly 30 may incorporate a nozzle. Also, other implements similar to the wand 35 may be placed into or inserted through the container 20 to the same effect.

The second fibers 16 are delivered into the container 20 in any known manner, including blowing, gravity feed, fluid jet, or electrospinning. As shown in FIGS. 1–3, fiber delivery assembly 40 may include an electrospinning device 41.

Electrospinning device 41 includes a first electrode 42 placed in electrical contact with the slurry 26, and a second electrode 43 suspended over the surface 32 of slurry 26, where second fibers 16 are created by electrical forces acting on a polymer introduced near the second electrode 43. The electrical forces eject a fiber 16 from the polymer, which then by force of the electrical field between the two electrodes 42, 43, air currents, or gravity is delivered on to the surface 32 of the slurry.

Since the second electrode 43 must electrically contact the slurry 26, there is a possibility that protrusion of the electrode into the slurry 26, such as when the electrode is passed through the surface 32 of the slurry 26, might cause the fiber 16, while being agitated, to wrap itself around or otherwise become entangled with the intruding electrode. Since the effects of such placement of the electrode may be minimal this method of contacting the slurry 26 should not be ruled out. To avoid passing the first electrode 42 through the surface 32, the first electrode 42 may contact the slurry 26 below its surface 32. In this instance, a sealed orifice 44 could be used to further minimize any risk of entanglement caused by the protrusion of the electrode 42 in the slurry 26.

In operation, first fibers 14 are provided in fluid medium 27 to form slurry 26. The slurry 26 is held within container 20. To aid in the attachment of fibers 14, 16, the slurry 26 may further comprise a suitable binder, a number of suitable binders are commercially available, such as, Carboset 560 from B. F. Goodrich. Agitation fluid 31 is provided from a supply to the current generating assembly 30, creating a mixing motion within the slurry 26. Second fibers 16 are delivered into the slurry 26 by fiber delivery assembly 40. When using the electrospinning technique, a power supply connected to the first and second electrodes 42, 43 is turned on and a bead of polymer is formed near the second electrode 43. The electrical forces between the electrodes 42, 43 eject second fiber 16 from the bead over the mixing apparatus 10, as previously described.

As the second fibers 16 fall onto the surface 32 of slurry 26, they are acted upon by the motion of the slurry 26 and drawn within the slurry 26 to mix with the first fibers 14. As the second fibers 16 fall onto the surface 32 of slurry 26, they are acted upon by the motion of the slurry 26 and drawn within the slurry 26 to mix with the first fibers 14. Since no mechanical elements attract the second fibers 16 and the mixing motion prevents the second fibers from agglomerating at the surface 32, the apparatus 10 forms a relatively uniform mixture of both fibers 14, 16 throughout the depth of the slurry 26. Like the slurry 26, any resulting multi-fiber structures made from the fiber mixture would exhibit the second fibers 16 having first fibers 14 located within the second fiber matrix. Photomicrographs of such multi-fiber structures, in this case a filter cake, are shown in FIGS. 10–13. In these figures the second fibers are long fiber, specifically, polymeric nanofiber, Nomex®, and the first fibers are short fibers, specifically glass fibers. The second fiber is characterized, in these figures, as being longer and thinner than the first fiber. The fibers relate with each other to form a fiber matrix. The first fibers can be seen penetrating the matrix, bridging gaps within the matrix to contact the second fibers or themselves. The second fibers, in turn, intertwine with and wrap around themselves and the first fibers.

Figure 5:
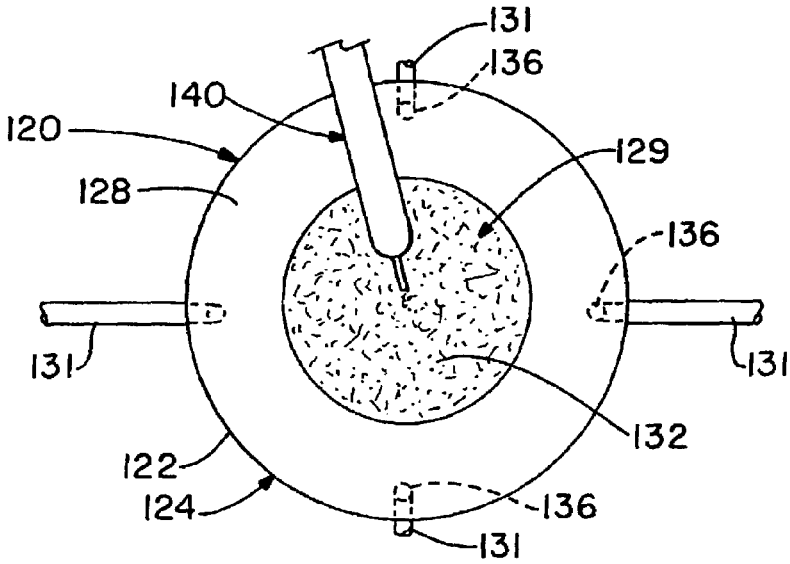
FIG. 5 is top view thereof.
Figure 6:
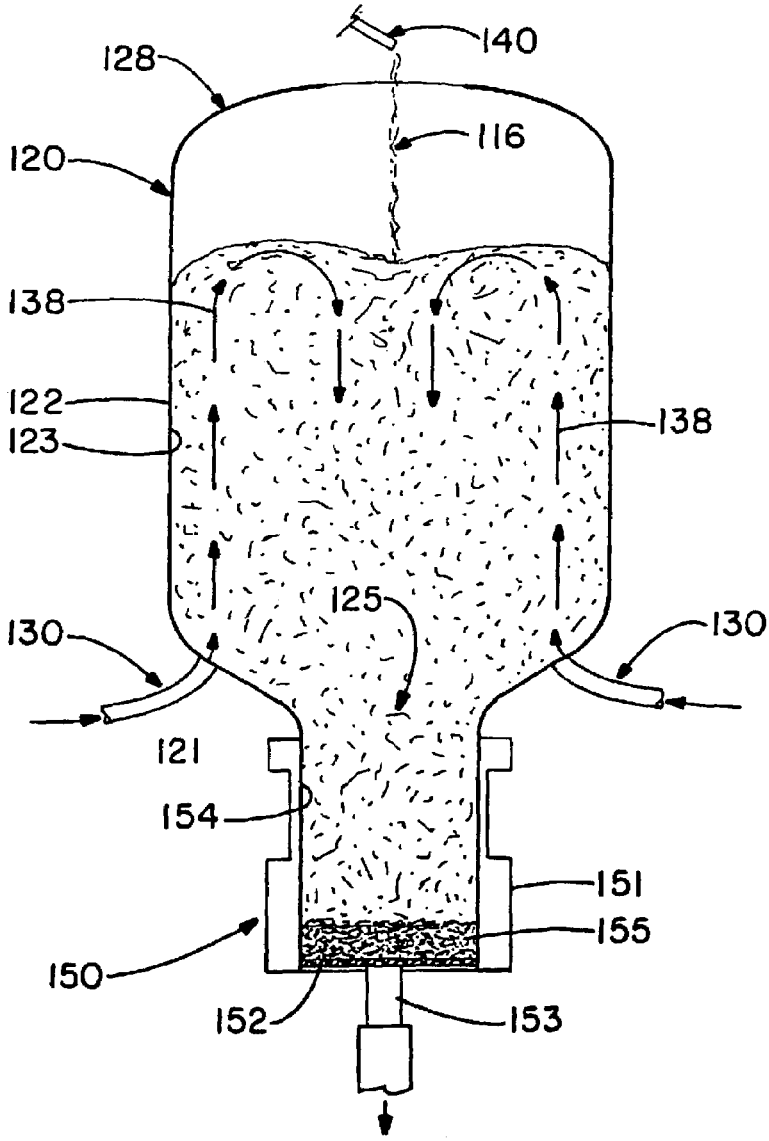
FIG. 6 is a front schematic view thereof depicting mixing of the fibers with the current generated by the current generating assembly represented by arrows.

FIGS. 4–6 depict an alternative mixing apparatus, generally indicated by the numeral 110. Apparatus 110, is similar to apparatus 10, and likewise includes a container 120, a current generating assembly 130, and a fiber delivery assembly 140. As discussed with respect to the first embodiment, appropriate fiber delivery assemblies are well known, and; thus, for this embodiment, the fiber delivery assembly is depicted and described generally. As shown in FIG. 4, container 120 has a generally cylindrical side wall 122 extending upwardly from a floor 121. The interior surface 123 of container 120 between floor 121 and side wall 122 may be rounded to provide a smooth transition between the floor 121 and side wall 122 at the perimeter 124 of container 120.

Floor 121 may be provided with an outlet 125 for draining the slurry 126. In the embodiment shown, outlet 125 is formed centrally within the floor 121, but may be located at any convenient point on the container 120. The floor 121 is sloped in the direction of the outlet 125 to facilitate drainage.

A splash shield 128 may be formed at the top of container 120. In the embodiment shown, shield 128 is made integral extending upwardly and inwardly from side wall 122 in an arcuate fashion. It will be appreciated that the shield 128 may take on other forms, such as an angular extension, or a separate shield 128 may be fastened or removably attached to the container 120. As shown, the shield 128 extends upwardly from the wall 122 of container 120. An opening 129 is formed centrally within shield 128 permitting access to the open end of container 120.

A current assembly 130 is provided to agitate slurry 126 as it rests in container 120. In contrast to the wand 35 of assembly 30, current assembly 130 generally includes a plurality of openings 136 located substantially at the perimeter 124 of floor 121. Openings 136 may be formed in floor 121 and spaced about the perimeter 124 thereof. In the embodiment shown, the openings 136 are radially spaced proximate the side wall 122.

Openings 136 introduce agitation fluid into the container 120 directing the agitation fluid upwardly from floor 121. Openings 136 receive the agitation fluid from a suitable supply. The agitation fluid may be channeled separately to each openings 136 or delivered to all of the openings 136 through a manifold. The agitation fluid 138 is delivered with sufficient pressure to develop a current 138 within slurry 126. This current 138 sets up a mixing motion and is used to mix the first and second fibers 114, 116, as described more completely below.

In the embodiment depicted in FIGS. 4–6, openings 136 are located in floor 121 near side wall 122 and are aimed generally parallel to side wall 122. In this way agitation fluid entering the container 120 develops a current 138 that is initially parallel to side wall 122. As the current reaches the surface 134 of slurry 126, the current is directed inwardly toward the center of container 120. At this point, the current 138 curls downwardly toward the floor 121. FIG. 6 depicts a schematic cross-section of container 120 with the current indicated by arrows. It will be appreciated that at this point the agitation fluid, used to generate the current 138, may escape at the surface or form a layer above the slurry surface 134, when the fluid has a density less than the slurry 122. In general, current 138 agitates slurry 126 to cause dispersion of the fibers 114, 116 within the slurry 126. In addition, fibers 114, 116 at or near the surface 136, including those falling on to the surface 136, of slurry 126 become entrained in the current 138. So entrained these fibers 114, 116 are circulated throughout the container 120, and fibers 114, 116, which ordinarily would agglomerate or float on the surface are carried downwardly into the slurry 126. As a result, second fibers 116 entering container 120 are drawn and circulated in the slurry 126 containing first fibers 114, 116 allowing the first fibers to penetrate a matrix (FIGS. 10–13) formed by the second fibers 116. Further, the fibers 114, 116 may encircle each other or become entangled with each other. In some instances, fibers 114 are found at depth or, in other words, suspended with the mixture. As a result of this mixing, an improved fiber mixture is obtained.

As described previously, second fiber 116 are generally provided into the container 120 by a fiber dispensing assembly 140. Any number of appropriate fiber dispensing assemblies 140 are available in the art and including devices which blow fibers, drop fibers, or electrospin fibers. Therefore, the fiber dispensing assembly 140 is depicted schematically and referred to generally.

Figure 7:
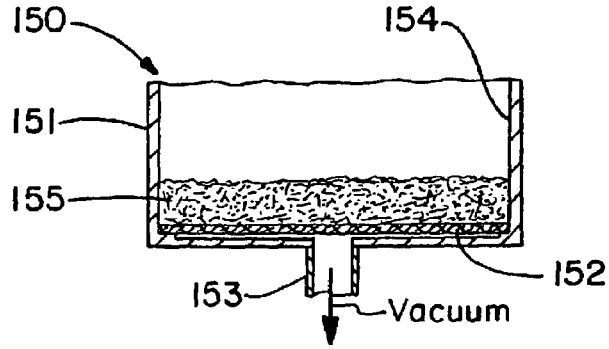
FIG. 7 is a partially schematic cross-sectional view of a fiber collection assembly according to the present invention having a cavity for creating a solid form multi-fiber structure.

Once the fibers 114, 116 are mixed, formation of a multi-fiber structure may be carried out by a suitable forming assembly. One such assembly, generally referred to by the numeral 150, is shown in FIG. 7. Forming assembly includes a vacuum head 151, which may be introduced into the rolling mixture of fibers 114, 116, drawing the mixture toward a porous membrane 152, where the mixed fibers are collected within a collection chamber defined by the interior wall 154 of head 151 and membrane 152. In the embodiment shown in FIG. 7, vacuum head 151 is attached to the drain 123 of container 120. In this way, fluid 127 within the fiber mixture may be drained from the container 120 with the mixed fibers collecting on the membrane 152 within the collection chamber. If necessary, a vacuum may be applied to hose 151 to aid in drawing the slurry fluid 127 from the fibers 114, 116. When the drain 123 is located at the bottom of the container 120, gravity may be used to drive this process. The remaining fluid 127 is conventionally drawn through the membrane 152 to a suitable reservoir or pumped back into the slurry 126. As the fluid is drained from the mixture, the mixture conforms to the interior surface 154 of the collection chamber. It will be appreciated that the interior wall 154 may have virtually any geometric shape to mold the resulting article as desired. Since the fibers are collected within the chamber, the collection chamber of forming assembly 150 is generally used to form a solid form multi-fiber structure.

Figure 8:
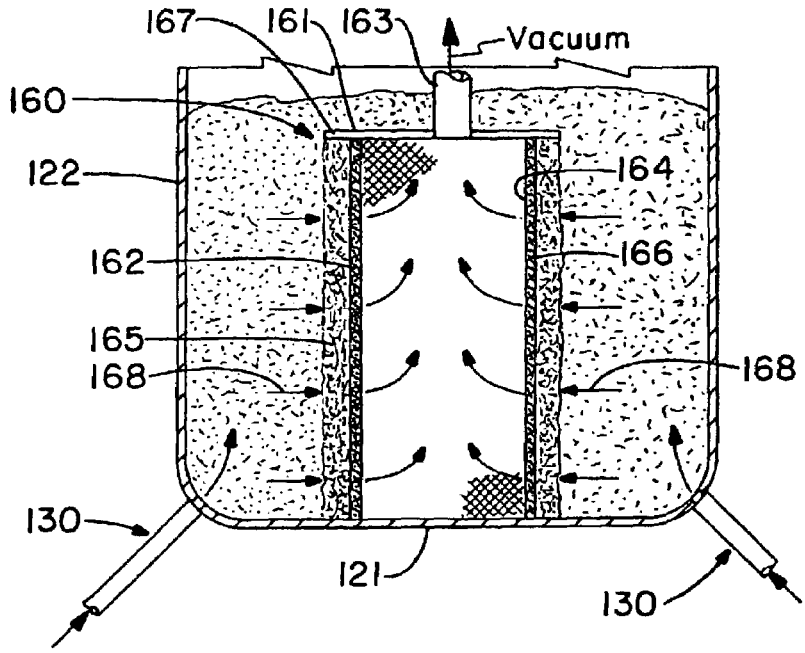
FIG. 8 is a view similar to FIG. 7 depicting a fiber collection assembly for creating a hollow multi-fiber structure.
Figure 9:
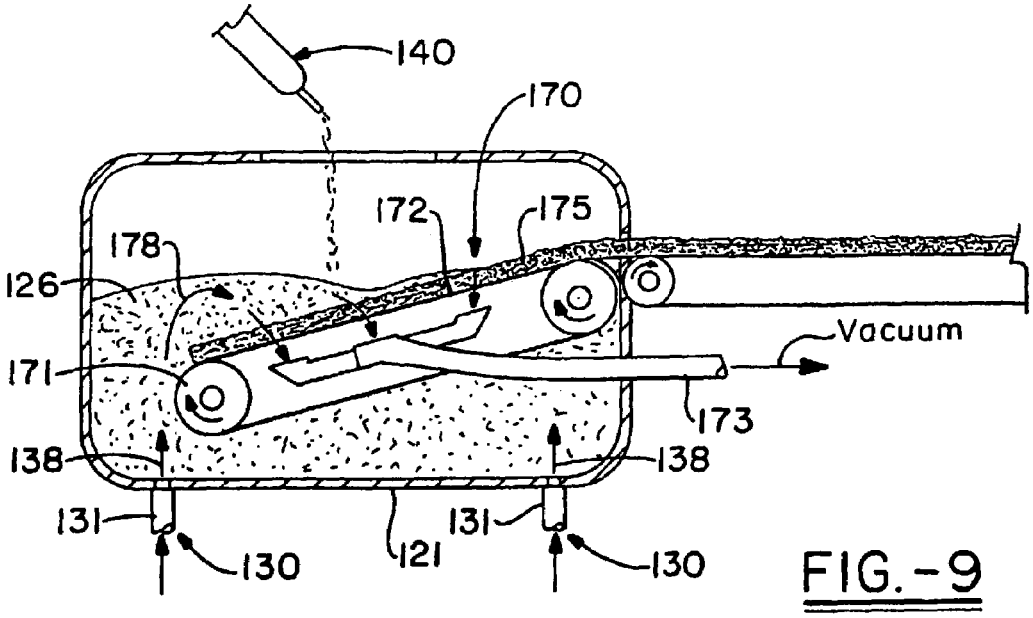
FIG. 9 is a view similar to FIG. 7 depicting a fiber collection assembly with its housing removed capable of forming a sheet-like multi-fiber structure.
Figure 10:
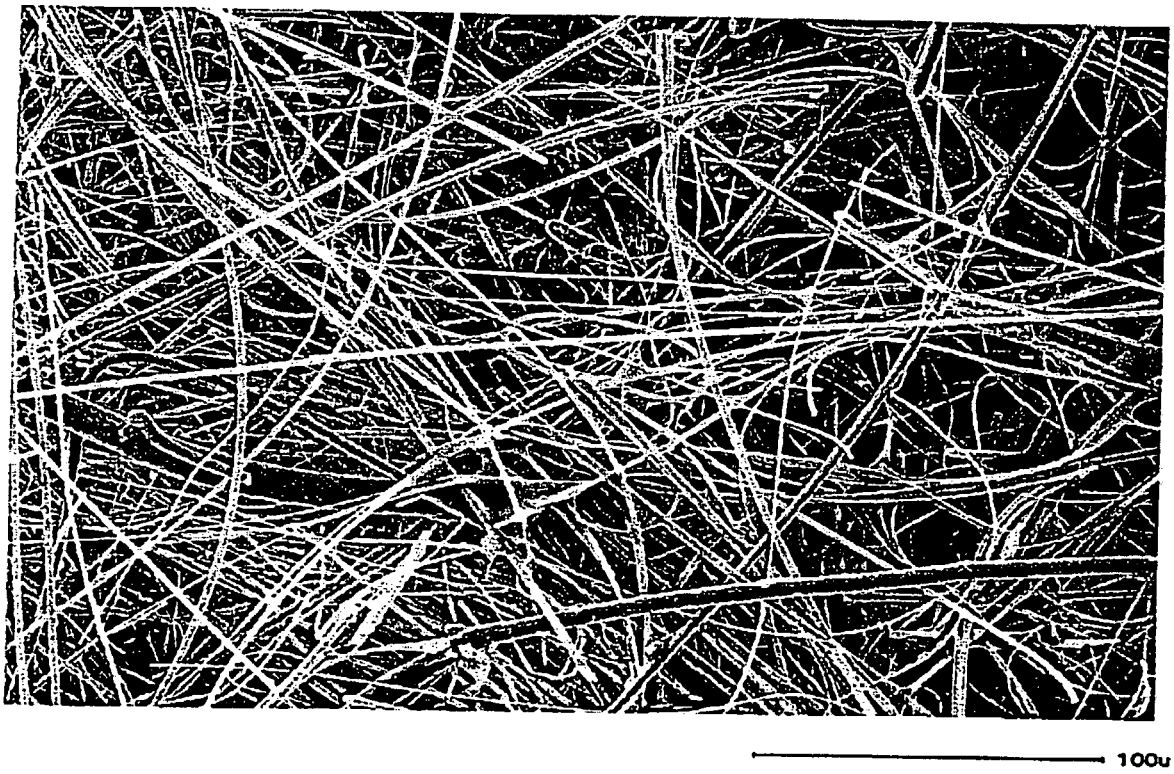
FIG. 10 is a micrograph at 100 microns scale depicting a multi-fiber structure made from a mixture of fibers and a binder according to the present invention.
Figure 11:
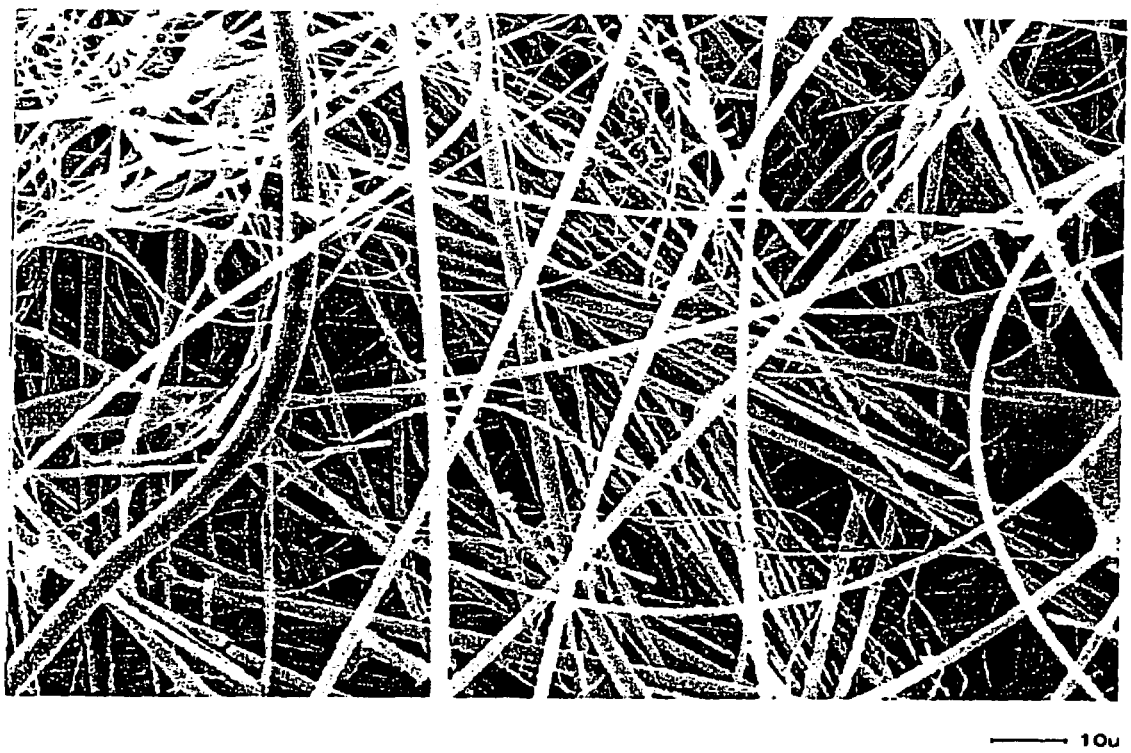
FIG. 11 is a micrograph at 10 microns scale depicting a multi-fiber structure made from a mixture of fibers and a binder according to the present invention.
Figure 12:
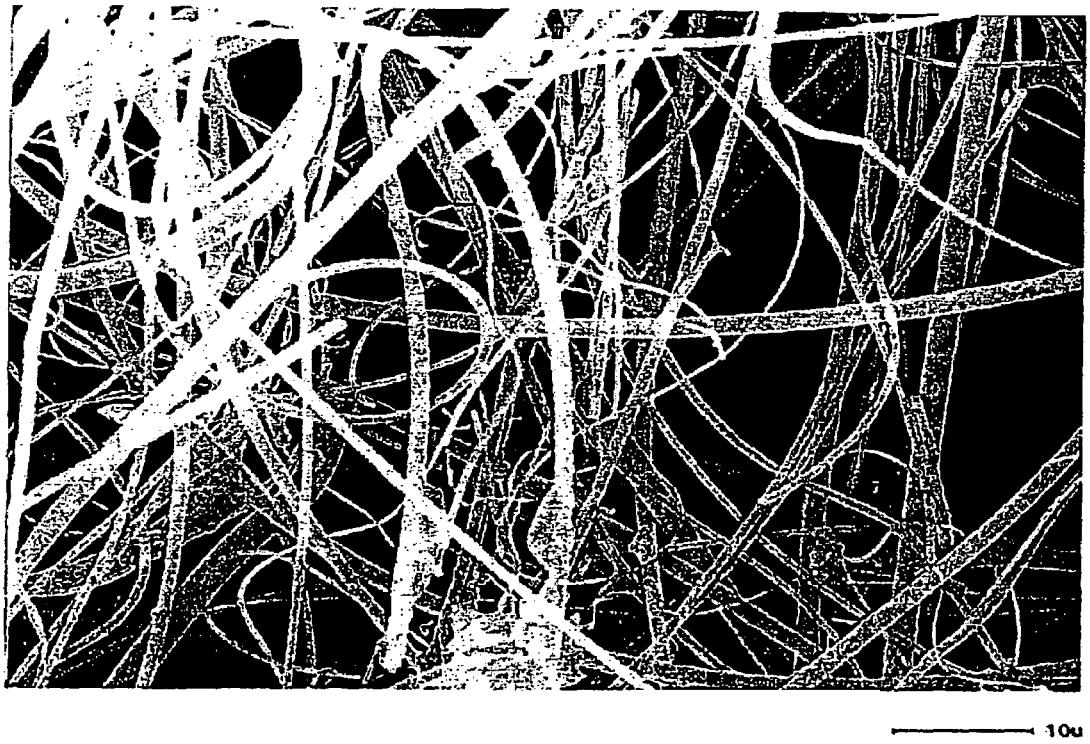
FIG. 12 is a micrograph at 10 microns scale depicting a multi-fiber structure made from a mixture of fibers and a binder according to the present invention.
Figure 13:
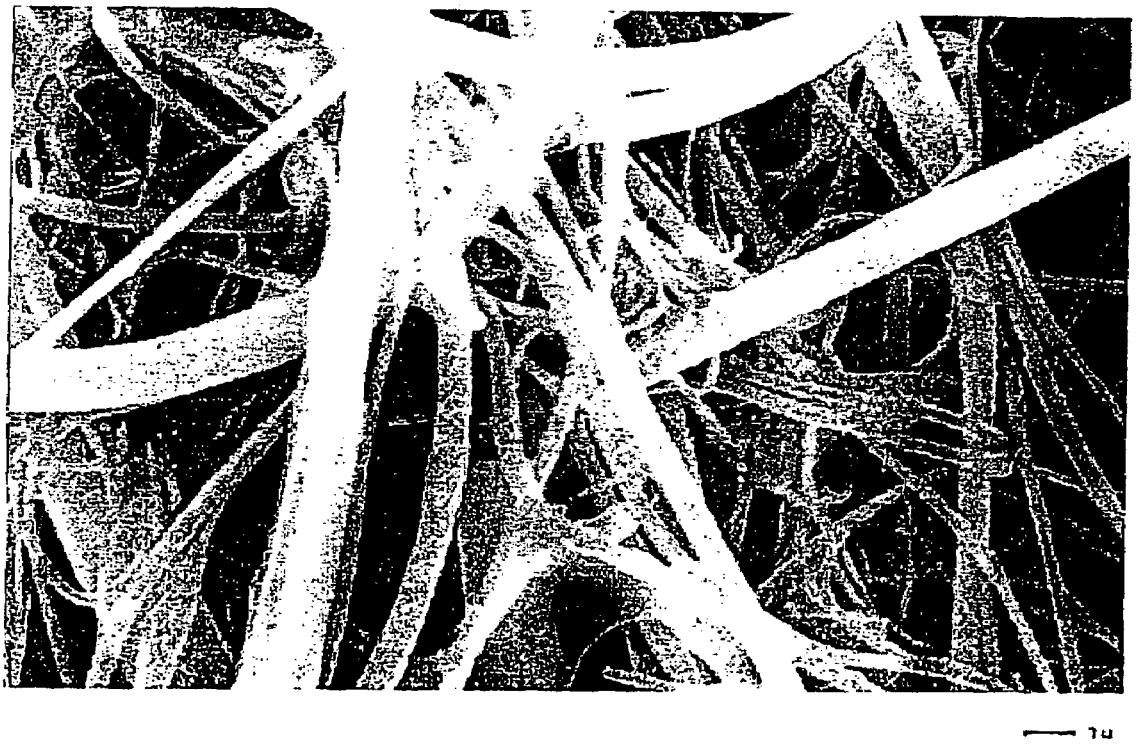
FIG. 13 is a micrograph at 1 micron scale depicting a multi-fiber structure made from a mixture of fibers and a binder according to the present invention.

As shown in FIG. 8, an alternative collection assembly 160 may be used to create hollow multi-fiber structures. When the floor 121 of container 120 is closed, as in FIG. 8, the forming assembly may be inserted into the container 120 to collect the fiber mixture. A forming assembly similar to assembly 150 could be used in this fashion to create a solid form multi-fiber structure. Forming assembly 160, however may be used to form a hollow multi-fiber structure by drawing fluid through the walls of the collection chamber as opposed to its base. To that end, the forming head 161 of forming assembly 160 has a porous membrane wall 162 that collects the fiber mixture 165 on its exterior surface 166 and allows passage of the slurry fluid 127 into the collection cavity defined by the interior surface 164 of head 161, where it is finally drawn off by a hose 163. The collection chamber 164 has a plate 167 at at least one end of the collection chamber 164 such that the fluid 127 is made to pass through the membrane wall 162, as depicted by arrows 168. When a single plate is used the open end of the collection chamber 164 may be placed against the floor 121 of the container 120 for this purpose. In the embodiment shown, collection chamber 164 has a plate 167 at opposite the floor 121 of the container 120. The plate is closed with the exception of an opening for the hose 163. The hose 163 communicates with the collection chamber 164 interiorly of membrane 162, such that, the slurry 126 is drawn radially inward through the cylindrical membrane wall 162. In this way, the fiber mixture 165 builds up on the exterior 166 of the wall 162 to form a generally tubular article. If the end opposite the hose 163 was closed and made porous a cup-like structure could be formed. As will be appreciated the membrane 162 may be formed into any desired shape to mold the resulting article In still another embodiment in the FIG. 9, a non-woven sheet may be formed on a membrane belt. In FIG. 9, the forming assembly 170 includes a circulating membrane belt 172 that is inserted at one end of container 120. Fibers 114, 116 are collected on the membrane 172, as is known in the art, and carried from the slurry 126 in a continuous fashion along the membrane belt 172. To aid in the collection of the mixed fibers 114, 116, a vacuum assembly may be place in registry with the belt 172 to draw the fibers to its exterior surface to form the article, slurry fluid 127 may be removed from the collected mixture by gravity, a vacuum assembly, a blower, or by baking or otherwise applying heat to the membrane. Heat treating may further be used to weld the fibers or give them certain surface characteristics. These processes are well-known and beyond the necessary description of the present invention. Once the collected fiber mixture sheet 175 is carried from the container 120, additional belts may be attached to transport the non-woven sheet 175 in a conveyor-like fashion. These conveyors may also be porous to remove excess fluid 127 as the non-woven sheet 175 is transported.

As will be readily appreciated, this process and apparatus for mixing fibers has wide application and may be used in paper-forming, mat-forming, filter-forming, membrane-forming processes, and other multi-fiber structure-forming processes. It is believed that any type of fibers may be used. The delivery of an agitation fluid provides a robust mixing force and can easily be modified in terms of the fluid itself or the delivery pressure to accommodate an infinite variety of fibers. If necessary, other process variables specific to certain fibers may be readily adjusted, as will be recognized by one of ordinary skill, to accommodate these fibers. For example, the pH level of the fluid making up the slurry may be adjusted to prevent the first fibers from clumping therein.

An experiment was performed using the above described apparatus to form a fiber cake useful in filtering applications. The following description of this experiment is provided for purposes of example and to aid the reader in understanding the utility and use of the apparatus. This discussion should not be read to limit the invention to the particulars contained herein. The experiment was initially conducted to observe the performance of simple glass filters in comparison to a filter containing a mixture of glass fibers and nanofiber. Filters found in the art typically contained only glass fibers and it was thought that mixing these fibers with a nanofiber could improve the performance of such filters. To form a glass and nanofiber mixture, an apparatus, similar to the one depicted in FIGS. 1–3, was used to mix two fibers; a glass fiber and a polymeric nanofiber. The glass fibers had lengths of about 1 micron to about 10 microns. The polymeric nanofiber was created by electrospinning from the Nomex® polymer. To create the fiber slurry, the glass fibers were placed in water with a small amount of binder. The slurry was placed in a container, and agitated by delivering air through a wand having a number of openings on its underside. The wand entered the container below the surface of the slurry allowing the air to bubble upwardly through the slurry and eventually release into the atmosphere. With the slurry being agitated, the nanofiber was electrospun on to the surface of the slurry. After a period of time, the electrospinning delivery was halted. A vacuum head was inserted into the slurry, while it was still being agitated, to collect a portion of the fiber mixture. Two cakes were formed from this mixture indicated as Mix 1 and Mix 2 in FIGS. 14 and 15. The cake represented as Mix 3 contained only glass fibers and a binder.

Figure 14:
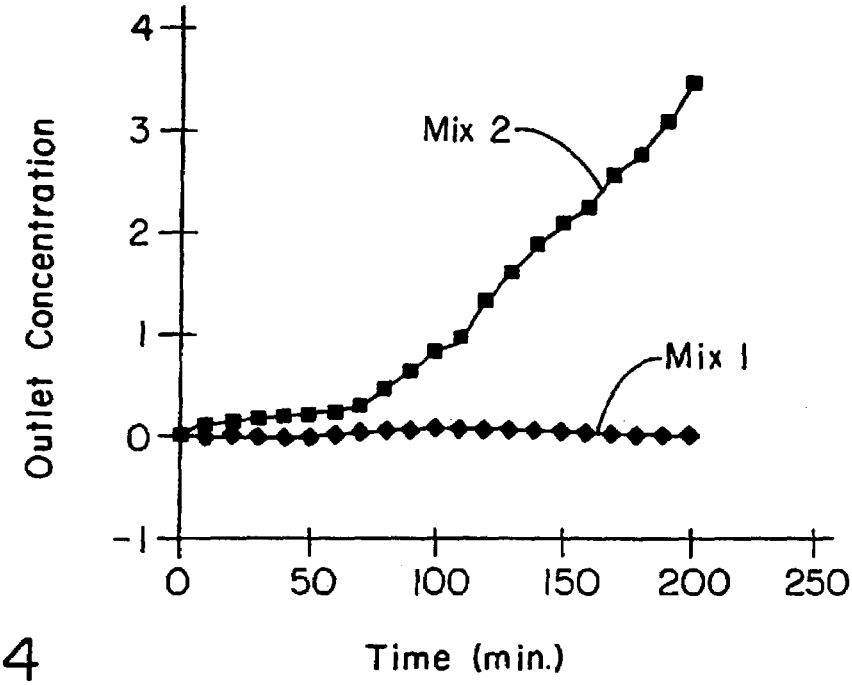
FIG. 14 is a representative plot of outlet concentration versus time for two fiber mixtures formed into filter cakes, the first mixture, Mix 1, having two grams of glass fibers, 0.07 grams of Nomex® fibers, and 10 milligrams per 4 liters of a binder and a second mixture, Mix 2, having 2 grams of glass fiber, 0.07 grams of Nomex® fibers, and 10 milligrams per 4 liters of binder.
Figure 15:
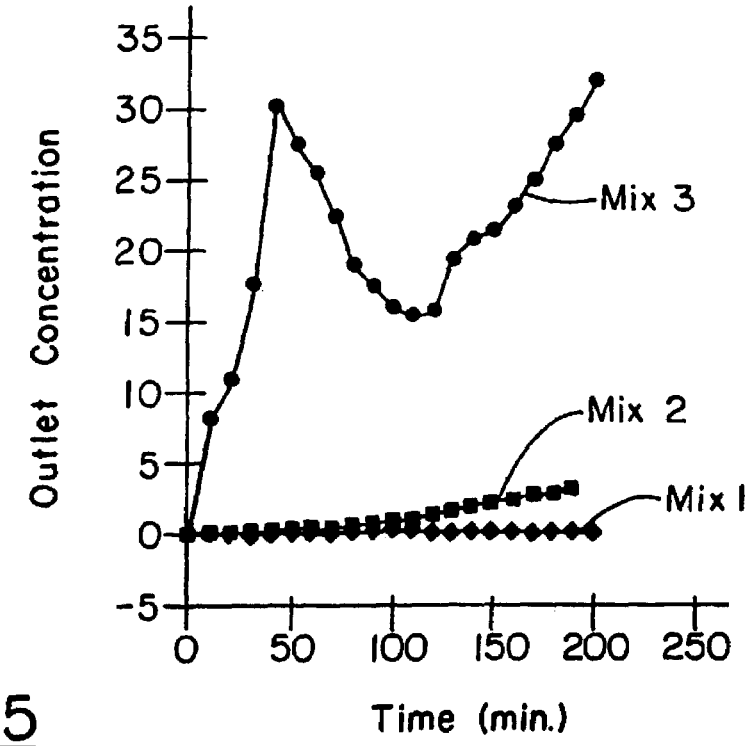
FIG. 15 is a representative plot of outlet concentration versus time for three fiber mixtures formed into filter cakes, the first mixture, Mix 1, having two grams of glass fibers, 0.07 grams of Nomex® fibers, and 10 milligrams per 4 liters of a binder, a second mixture, Mix 2, having 2 grams of glass fiber, 0.07 grams of Nomex® fibers, and 10 milligrams per 4 liters of binder, and a third mixture, Mix 3, having 2 grams of glass fibers with 10 milligrams per 4 liters of binder.

The filtration capability of the cakes were tested by examining the outlet concentration of the cakes over time. Plots of the Mix 1 and Mix 2 cakes, shown in FIG. 14 show fairly consistent behavior in two samples of the mixed fibers. FIG. 15 depicts a comparison of the fiber mixtures relative to Mix 3, which contained only the glass fibers. As can be seen from this plot, the mixed fibers exhibited improved filtering properties relative to a simple glass fiber filter.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby.

Accordingly, for an appreciation of true scope and breadth of the invention, reference should be made to the following claims.

What is claimed is:

1. A fiber-mixing apparatus comprising:

a container for receiving a slurry having short fibers therein;

a fluid delivery assembly having at least one opening in said communication with the container and a fluid supply, whereby the fluid delivery assembly delivers an agitation fluid into the slurry; and a long fiber delivery assembly delivering long fibers into the slurry, the long fiber being of a length sufficient to cause fiber agglomeration under mechanical mixing, whereby delivery of the agitation fluid causes mixing of the long fibers and short fibers, wherein the fluid delivery assembly includes an opening in communication with the container, and wherein the fluid delivery assembly includes a nozzle formed in the container, wherein the nozzle defines the opening.

2. The apparatus of claim 1, wherein the nozzle of the fluid delivery assembly has a plurality of openings in communication with the slurry such that the fluid enters the slurry at the openings.

3. The apparatus of claim 2, wherein the fluid delivery assembly further includes a wand extending into the container wherein the openings are formed in the wand.

4. The apparatus of claim 3, wherein the wand has a top and a bottom and wherein the openings are formed on the bottom of the wand.

5. The apparatus of claim 3, wherein the wand is located near the bottom of the container.

6. The apparatus of claim 1, wherein the fluid delivery assembly further includes a plurality of openings spaced from each other about a periphery of the container.

7. The apparatus of claim 1, wherein the agitation fluid is air.

8. A fiber-mixing apparatus comprising:

a container for receiving a slurry having short fibers therein;

a fluid delivery assembly having at least one opening in fluid communication with the container and a fluid supply, whereby the fluid delivery assembly delivers an agitation fluid into the slurry; and a fiber delivery assembly delivering long fibers into the slurry, whereby delivery of the agitation fluid causes mixing of the long fibers and short fibers, wherein the fluid delivery assembly includes a plurality of openings spaced from each other about a periphery of the container and wherein the container has a floor and the openings are formed in the floor.

9. A method of mixing comprising:

placing a liquid slurry containing a first fiber into a container;

delivering a second fiber onto a surface of the slurry, wherein the second fiber is of a length sufficient to cause fiber agglomeration under mechanical mixing; and introducing an agitation fluid into the slurry to cause a mixing motion that draws the second fiber from the surface of the slurry into the slurry, thereby yielding a matrix composed of the first and second fibers, wherein the second fiber is found at a depth within the matrix of the first fiber and the second fiber is substantially free from agglomeration, wherein the step of delivering a second fiber includes providing a fiber having a length on the order of kilometers and wherein the step of delivering the second fiber includes electrospinning a second fiber onto the surface of the slurry.

10. The method of claim 9, where the agitation fluid is delivered beneath the surface of the slurry.

11. The method of claim 10, wherein delivering the agitation fluid into the slurry occurs through an opening formed in a wand penetrating the container.

12. The method of claim 9, wherein delivery of the agitation fluid occurs through a plurality of openings space along a perimeter of the container.

13. A fiber-mixing apparatus comprising:

a container for receiving a liquid slurry having a first fiber dispersed therein;

a fluid delivery assembly in fluid communication with the container and a fluid supply, whereby the fluid delivery assembly delivers an agitation fluid into the slurry;

a delivery assembly delivering a second fiber onto a surface of the slurry, wherein the fluid delivery assembly generates a current adapted to draw the second fiber downward from the surface of the slurry to cause mixing of the first and second fibers wherein the delivery assembly includes an electrospinning assembly that is adapted to form a second fiber having a length on the order of kilometers.

* * * * *